US010115352B2

(12) United States Patent
Xing et al.

(10) Patent No.: US 10,115,352 B2
(45) Date of Patent: Oct. 30, 2018

(54) BACKLIGHT DRIVING CIRCUIT, LIQUID CRYSTAL DISPLAY AND BACKLIGHT ADJUSTING METHOD

(71) Applicant: Wuhan China Star Optoelectronics Technology Co., Ltd., Wuhan, Hubei (CN)

(72) Inventors: Zhenzhou Xing, Guangdong (CN); Qingcheng Zuo, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 434 days.

(21) Appl. No.: 14/905,820

(22) PCT Filed: Dec. 30, 2015

(86) PCT No.: PCT/CN2015/099780
§ 371 (c)(1),
(2) Date: Jan. 17, 2016

(87) PCT Pub. No.: WO2017/096665
PCT Pub. Date: Jun. 15, 2017

(65) Prior Publication Data
US 2017/0229072 A1 Aug. 10, 2017

(51) Int. Cl.
*G09G 3/34* (2006.01)
*G09G 3/36* (2006.01)

(52) U.S. Cl.
CPC ..... *G09G 3/3406* (2013.01); *G09G 3/3607* (2013.01); *G09G 2310/027* (2013.01);
(Continued)

(58) Field of Classification Search
CPC ..... G02F 1/1336–1/133621; G09G 2320/062–2320/0653; G09G 3/3406–3/342
See application file for complete search history.

(56) References Cited

U.S. PATENT DOCUMENTS

2008/0218284 A1* 9/2008 Chen ..... H03K 7/10 332/108
2011/0141002 A1* 6/2011 Kim ..... G09G 3/342 345/102

(Continued)

FOREIGN PATENT DOCUMENTS

CN 101430863 A 5/2009
CN 101609650 A 12/2009

(Continued)

*Primary Examiner* — Kumar Patel
*Assistant Examiner* — Amy C Onyekaba
(74) *Attorney, Agent, or Firm* — Andrew C. Cheng

(57) ABSTRACT

The present disclosure provides a backlight driving circuit, which includes a backlight source, an image collecting circuit, a comparing circuit, a PWM generating circuit, a PFM generating circuit, a driving circuit and a backlight driving circuit, the image collecting circuit outputs a grayscale value of a current frame to the driving circuit; the driving circuit transmits a grayscale variation value to the comparing circuit; the comparing circuit outputs a control signal for the PWM generating circuit or a control signal for the PFM generating circuit; the PWM generating circuit generates a PWM signal or the PFM generating circuit generates a PFM signal and outputs it to the backlight driving circuit; the backlight driving circuit changes a current of the backlight source for dimming. This circuit may decrease the whole energy loss of the backlight adjusting process and increase the working efficiency of the circuit.

11 Claims, 1 Drawing Sheet

(52) U.S. Cl.
CPC . *G09G 2320/062* (2013.01); *G09G 2320/064* (2013.01); *G09G 2320/0613* (2013.01); *G09G 2320/0626* (2013.01); *G09G 2320/0646* (2013.01); *G09G 2330/021* (2013.01); *G09G 2360/16* (2013.01)

(56) References Cited

U.S. PATENT DOCUMENTS

| | | | | |
|---|---|---|---|---|
| 2013/0249958 | A1* | 9/2013 | Matsuura | G09G 3/3426 345/690 |
| 2013/0321484 | A1* | 12/2013 | Kim | G09G 3/3233 345/690 |
| 2014/0340000 | A1* | 11/2014 | Zhang | G09G 3/3406 315/307 |
| 2015/0115813 | A1* | 4/2015 | Hussain | G09G 3/3406 315/186 |
| 2016/0133205 | A1* | 5/2016 | Kwon | G09G 3/342 345/690 |
| 2016/0345395 | A1* | 11/2016 | Chen | H05B 33/0815 |

FOREIGN PATENT DOCUMENTS

| | | | | |
|---|---|---|---|---|
| CN | 101630906 | A | 1/2010 | |
| CN | 102708804 | A | * 10/2012 | G09G 3/34 |
| CN | 104221076 | A | 12/2014 | |
| JP | 2012095518 | A | 5/2012 | |
| KR | 101387506 | B1 | 4/2014 | |
| TW | 201105016 | A1 | 2/2011 | |

* cited by examiner

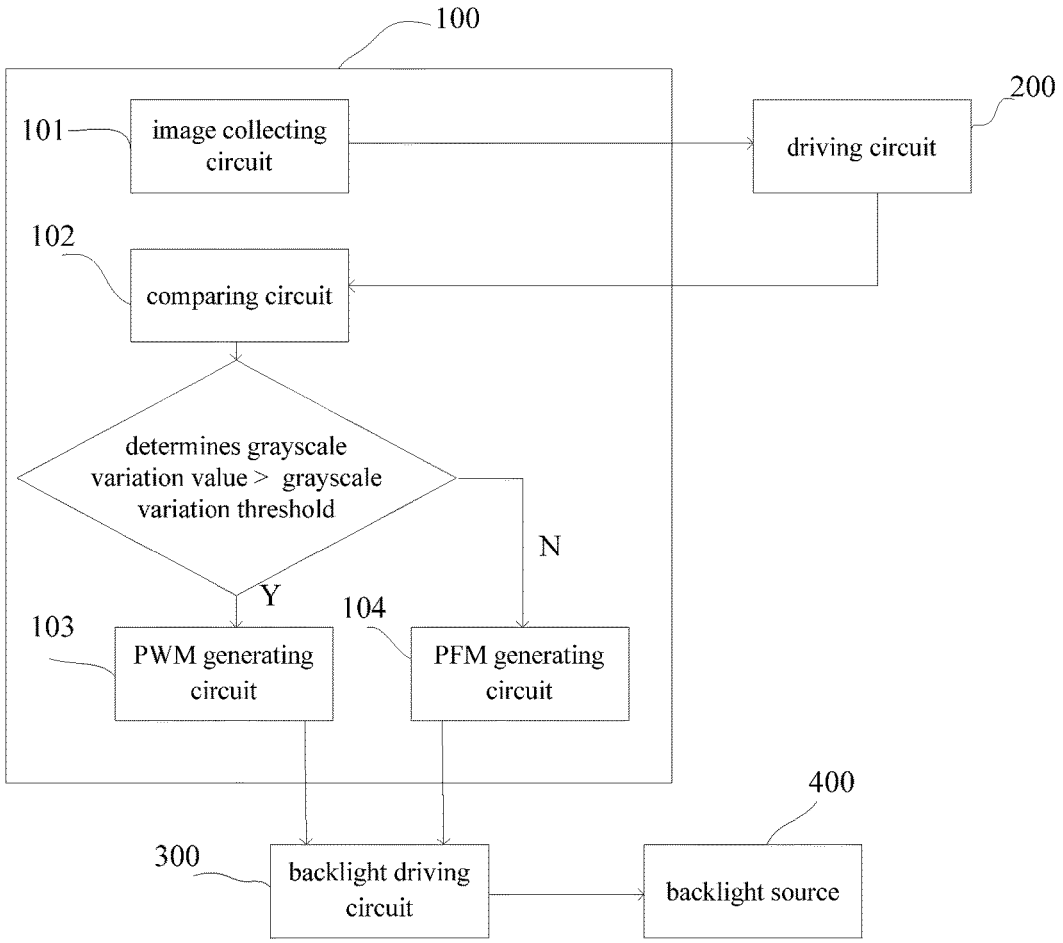
100
101
image collecting circuit
driving circuit
200
102
comparing circuit
determines grayscale variation value > grayscale variation threshold
N
Y
103
PWM generating circuit
104
PFM generating circuit
400
300
backlight driving circuit
backlight source

BACKLIGHT DRIVING CIRCUIT, LIQUID CRYSTAL DISPLAY AND BACKLIGHT ADJUSTING METHOD

CROSS REFERENCE

This application claims the benefit of, and priority to, Chinese Patent Application No. 201510903551.3, filed Dec. 9, 2015, titled "backlight driving circuit, liquid crystal display and backlight adjusting method", the entire contents of which are incorporated by reference herein in its entirety.

FIELD OF THE INVENTION

The disclosure is related to liquid crystal display technology field, and more particular to a backlight driving circuit, a liquid crystal display and a backlight adjusting method.

BACKGROUND OF THE INVENTION

Since the vigorous development of electronic technology, the electronic product has been widely used, and therefore, the problem of the power supply used by the electronic product becomes a very important issue. Currently, the electronic product generally uses a switching type power supplying manner to realize supplying the power, and the switching type may perform a switching operation of the switch through the pulse width modulation (PWM) technique or the pulse frequency modulation (PFM) technique.

Because a grayscale image in the liquid crystal display has 256 grayscale values, the grayscale value is a concept of the brightness. A range of the color shade is 0 to 255, where 0 is black and 255 is white. When a variation of the grayscale value of the electronic product is larger, the load of the liquid crystal display is also larger. Otherwise, the load of the liquid crystal display is also smaller. Usually, when the electronic product works under a large load condition, it uses the pulse width modulation (PWM) technique to control the switching action of the switch; at this time, the pulse width modulation (PWM) technique has good efficiency and better control performance, and the working loss thereof has a transmitting loss and a switching loss. When the electronic product is at a light load, if it still uses the pulse width modulation (PWM) technique to control the switching action of the switch, at this time, the transmitting loss may be decreased due to the electronic product at the light load; however, since a switching frequency is fixed, the switching loss does not decrease as the load decreases. Therefore, when the electronic product is at the light load, it still uses the working mode of the pulse width modulation (PWM), such that the whole loss is large, the efficiency is decreased, and it is not conducive to energy-saving design.

Usually, when the electronic product works under a light load condition, it generally uses the pulse frequency modulation (PFM) technique to control a switching action of a switch. Namely, when the load is decreased, a switch frequency of the switch is also decreased, thereby decreasing the switching loss of the switch and maintaining the higher working efficiency.

Therefore, the electronic product may automatically select the pulse width modulation (PWM) technique or the pulse frequency modulation (PFM) technique to turn on or turn off the switching mode according to the load state, which is the trend of the electronic development.

SUMMARY OF THE INVENTION

A purpose of the present disclosure is to provide a backlight driving circuit, which may automatically select a pulse width modulation (PWM) technique or a pulse frequency modulation (PFM) technique to turn on or turn off a switching mode according to a grayscale variation value.

Another purpose of the present disclosure provides a liquid crystal display using the above backlight driving circuit.

Another purpose of the present disclosure provides a backlight adjusting method.

In order to achieve the above purpose, the embodiment of the present disclosure provides the following technical schemes:

The present disclosure provides a backlight driving circuit, which includes a backlight source, an image collecting circuit, a comparing circuit, a PWM generating circuit, a PFM generating circuit, a driving circuit and a backlight driving circuit, wherein the image collecting circuit is used to output a grayscale value of a current frame to the driving circuit;

wherein the driving circuit is used to calculate a grayscale variation value of a grayscale value of a target frame and the grayscale value of the current frame, and transmit the grayscale variation value to the comparing circuit;

wherein the comparing circuit is used to compare the grayscale variation value calculated by the driving circuit with a predetermined grayscale variation threshold, and generate a control signal for the PWM generating circuit or a control signal for the PFM generating circuit;

wherein the PWM generating circuit is used to generate a PWM signal in response to the control signal for the PWM generating circuit and output the PWM signal to the backlight driving circuit;

wherein the PFM generating circuit is used to generate a PFM signal in response to the control signal for the PFM generating circuit and output the PFM signal to the backlight driving circuit; and wherein the backlight driving circuit is used to change a current of the backlight source for dimming in response to the PWM signal or the PFM signal.

In one embodiment, the predetermined grayscale variation threshold of the comparing circuit is 26.

In one embodiment, the PFM generating circuit for generating the PFM signal includes adjusting a time interval of the PFM signal in real time until a backlight current currently outputted to the backlight source by the backlight driving circuit achieves a target value of the backlight current according to the backlight current currently outputted to the backlight source by the backlight driving circuit.

In one embodiment, the PWM generating circuit for generating the PWM signal includes adjusting a duty cycle of the PWM signal in real time until a backlight current currently outputted to the backlight source by the backlight driving circuit achieves a target value of the backlight current according to the backlight current currently outputted to the backlight source by the backlight driving circuit.

In one embodiment, the PWM generating circuit and the PFM generating circuit are respectively implemented by a square wave generator.

The present disclosure provides a liquid crystal display, which includes a backlight driving circuit, the backlight driving circuit includes a backlight source, an image collecting circuit, a comparing circuit, a PWM generating circuit, a PFM generating circuit, a driving circuit and a backlight driving circuit, wherein the image collecting circuit is used to output a grayscale value of a current frame to the driving circuit;

wherein the driving circuit is used to calculate a grayscale variation value of a grayscale value of a target frame and the grayscale value of the current frame, and transmit the grayscale variation value to the comparing circuit;

wherein the comparing circuit is used to compare the grayscale variation value calculated by the driving circuit with a predetermined grayscale variation threshold, and generate a control signal for the PWM generating circuit or a control signal for the PFM generating circuit;

wherein the PWM generating circuit is used to generate a PWM signal in response to the control signal for the PWM generating circuit and output the PWM signal to the backlight driving circuit;

wherein the PFM generating circuit is used to generate a PFM signal in response to the control signal for the PFM generating circuit and output the PFM signal to the backlight driving circuit; and wherein the backlight driving circuit is used to change a current of the backlight source for dimming in response to the PWM signal or the PFM signal.

In one embodiment, the predetermined grayscale variation threshold of the comparing circuit is 26.

In one embodiment, the PFM generating circuit for generating the PFM signal includes adjusting a time interval of the PFM signal in real time until a backlight current currently outputted to the backlight source by the backlight driving circuit achieves a target value of the backlight current according to the backlight current currently outputted to the backlight source by the backlight driving circuit.

In one embodiment, the PWM generating circuit for generating the PWM signal includes adjusting a duty cycle of the PWM signal in real time until a backlight current currently outputted to the backlight source by the backlight driving circuit achieves a target value of the backlight current according to the backlight current currently outputted to the backlight source by the backlight driving circuit.

In one embodiment, the PWM generating circuit and the PFM generating circuit are respectively implemented by a square wave generator.

The present disclosure provides a backlight adjusting method, which includes the following steps:

transmitting a grayscale value of a current frame to a driving circuit by a image collecting circuit;

calculating a grayscale variation value of a grayscale value of a target frame and the grayscale value of the current frame, and transmitting the grayscale variation value to a comparing circuit by the driving circuit;

comparing the grayscale variation value with a predetermined grayscale variation threshold by the comparing circuit; when the grayscale variation value obtained by the comparing circuit is greater than the predetermined grayscale variation threshold, a PWM generating circuit generates a PWM signal and outputs the PWM signal to a backlight driving circuit; when the grayscale variation value obtained by the comparing circuit is less than or equals to the predetermined grayscale variation threshold, a PFM generating circuit generates a PFM signal and outputs the PFM signal to the backlight driving circuit; and dimming by the backlight driving circuit through the inputted PWM signal or the inputted PFM signal.

In one embodiment, the predetermined grayscale variation threshold of the comparing circuit is 26.

In one embodiment, the PFM generating circuit for generating the PFM signal includes adjusting a time interval of the PFM signal in real time until a backlight current currently outputted to the backlight source by the backlight driving circuit achieves a target value of the backlight current according to the backlight current currently outputted to the backlight source by the backlight driving circuit.

In one embodiment, the PWM generating circuit for generating the PWM signal includes adjusting a duty cycle of the PWM signal in real time until a backlight current currently outputted to the backlight source by the backlight driving circuit achieves a target value of the backlight current according to the backlight current currently outputted to the backlight source by the backlight driving circuit.

The present disclosure has the following advantage or beneficial efficiency.

In the present disclosure, the image collecting circuit transmits the grayscale value of the frame to the driving circuit, the driving circuit calculates a difference of the grayscale value of the current frame and the grayscale value of the target frame and feedbacks the difference to the comparing circuit; when the grayscale variation value obtained by the comparing circuit is greater than the predetermined grayscale variation threshold, the PWM generating circuit generates the PWM signal and outputs the PWM signal to the backlight driving circuit; otherwise, the PFM generating circuit generates the PFM signal and outputs the PFM signal to the backlight driving circuit, thereby reducing the whole energy loss of the backlight adjusting process, and increasing a working efficiency of the circuit.

BRIEF DESCRIPTION OF THE DRAWINGS

In order to more clearly illustrate the prior art or the embodiments or aspects of the practice of the disclosure, the accompanying drawings for illustrating the prior art or the embodiments of the disclosure are briefly described as below. It is apparently that the drawings described below are merely some embodiments of the disclosure, and those skilled in the art may derive other drawings according the drawings described below without creative endeavor.

FIG. 1 is a structure schematic view of a backlight driving circuit according to an embodiment of the present disclosure.

DETAILED DESCRIPTION

The following description with reference to the accompanying drawings is provided to clearly and completely explain the exemplary embodiments of the present disclosure. It is apparent that the following embodiments are merely some embodiments of the present disclosure rather than all embodiments of the present disclosure. According to the embodiments in the present disclosure, all the other embodiments attainable by those skilled in the art without creative endeavor belong to the protection scope of the present disclosure.

Please refers to FIG. 1, a backlight driving circuit of the present disclosure includes a master control circuit 100, a driving circuit 200, a backlight driving circuit 300 and a backlight source 400. The master control circuit 100 includes: an image collecting circuit 101, a comparing circuit 102, a PWM generating circuit 103 and a PFM generating circuit 104. The image collecting circuit 101 is used to extract a character parameter of an image data, i.e. collect a grayscale value of the current frame. The grayscale value a concept of the brightness, and a range of the grayscale value is 0 to 255, which indicates that the brightness from dark to light and the color in the corresponding image from black to white, and each of pixel values is one of 256 grayscales between black and white. The image collecting circuit 101 of the master control circuit 100 transmits the collected grayscale value of the current frame to the driving circuit 200. The driving circuit 200 receives the grayscale value of the current frame, and calculates a grayscale variation value of a grayscale value of a target frame and the grayscale value of the current frame. After the grayscale variation value is calculated, the driving circuit 200 transmits the grayscale variation value to the comparing circuit 102 of the master control circuit 100. The comparing circuit 102 compares the grayscale variation value with a predetermined grayscale threshold. At this time, when the grayscale variation value is higher than the predetermined grayscale threshold, the comparing circuit 102 generates a control signal for the PWM generating circuit to control the PWM generating circuit 103, and after receiving the control signal, the PWM generating circuit 103 generates a PWM signal and output the PWM signal to the backlight driving circuit 300, so as to adjust the brightness of the backlight module. At this time, when the grayscale variation value is lower than the predetermined grayscale threshold, the comparing circuit 102 generates a control signal for the PFM generating circuit to control the PFM generating circuit 104, PFM generating circuit 104 generates a PFM signal and outputs the PFM signal to the backlight driving circuit 300, and the backlight driving circuit 300 dims according to the PFM signal. Specifically, the backlight driving circuit 300 changes a current of the backlight source for dimming, so as to achieve the grayscale value of the target frame.

In the present disclosure, the image collecting circuit of the master control circuit transmits the grayscale value of the frame to the driving circuit, the driving circuit calculates a difference of the grayscale value of the current frame and the grayscale value of the target frame and feedbacks the difference to the comparing circuit of the master control circuit; when the grayscale variation value is greater than the predetermined grayscale variation threshold, the PWM generating circuit of the master control circuit generates the PWM signal and outputs the PWM signal to the backlight driving circuit; otherwise, the PFM generating circuit of the master control circuit generates the PFM signal and outputs the PFM signal to the backlight driving circuit, thereby reducing the whole energy loss of the backlight adjusting process, and increasing a working efficiency of the circuit.

Further, the grayscale variation threshold may be about 10% of the range of grayscale value, and the grayscale value of the image is between 0 and 255. That is, the grayscale variation threshold may be set as 26. Specifically, when the grayscale value of the current frame is 200 and the grayscale value of the target frame is 255 (or when the grayscale value of the current frame is 255 and the grayscale value of the target frame is 200), i.e. the grayscale variation value is 55>26, the grayscale variation value is smaller and the load is larger at this time, thus it needs using the PWM adjusting. The comparing circuit 102 outputs the control signal for the PWM generating circuit, and the PWM generating circuit 103 generates the PWM signal in response to the control signal for the PWM generating circuit and outputs the PWM signal to the backlight driving circuit 300. Or, when he grayscale value of the current frame is 200 and the grayscale value of the target frame is 215 (or when the grayscale value of the current frame is 215 and the grayscale value of the target frame is 200), i.e. the grayscale variation value is 15<26, the grayscale difference value, the backlight need to be adjusted, is smaller and the load is also smaller, thus it needs using the PFM adjusting. The comparing circuit 102 outputs the control signal for the PFM generating circuit, and the PFM generating circuit 104 generates the PFM signal in response to the control signal for the PFM generating circuit and outputs the PFM signal to the backlight driving circuit 300.

Specifically, in the process of the PFM generating circuit 104 generates the PFM signal, it may further adjust a time interval of the PFM signal in real time until a backlight current currently outputted to the backlight source by the backlight driving circuit 300 achieves a target value of the backlight current according to the backlight current currently outputted to the backlight source by the backlight driving circuit 300. In other words, the PFM generating circuit 104 may adjust the time interval of the PFM signal in real time until the grayscale value of the current frame equals to the grayscale value of the target frame.

Specifically, in the process of the PWM generating circuit 103 generates the PWM signal, it may further adjust a duty cycle of the PWM signal in real time until a backlight current currently outputted to the backlight source by the backlight driving circuit 300 achieves a target value of the backlight current according to the backlight current currently outputted to the backlight source by the backlight driving circuit 300. In other words, the PWM generating circuit 103 may adjust the duty cycle of the PWM signal in real time until the grayscale value of the current frame equals to the grayscale value of the target frame.

Further, specifically, the above PWM generating circuit and the PFM generating circuit are respectively implemented by a square wave generator, the specific process is prior art and the description thereof is omitted.

Further, specifically, the backlight driving circuit 300 may includes: an input filter, a power switch, an inductor or a transformer, an output rectifier or filter, a dimming controller and a master control circuit, wherein an input terminal Vin is connected to a power source, a output terminal Vout outputs a backlight current and a backlight voltage to a LED backlight source, and the output terminal Vout is connected to the dimming controller and further feedbacks the outputted backlight current to the dimming controller.

Further, specifically, the backlight source may be a LED light bar.

The present disclosure further provides a liquid crystal display, the liquid crystal display includes any one of the above backlight driving circuit, and the liquid crystal display may be applied to any electronic device with display function, such as a mobile phone, a tablet computer, a television, a monitor, a notebook computer, a digital picture frame, a navigation system, etc.

The present disclosure further provides a backlight adjusting method, which includes the following steps:

providing a driving circuit and a master control circuit including an image collecting circuit, a comparing circuit, a PWM generating circuit and a PFM generating circuit, and the image collecting circuit of the master control circuit firstly transmits the collected grayscale value of current frame to the driving circuit;

then, the driving circuit calculates a grayscale variation value of a grayscale value of a target frame and the grayscale value of the current frame, and feedbacks the grayscale variation value to a comparing circuit of the master control circuit for comparing;

the comparing circuit receives the grayscale variation value calculated by the driving circuit, and compares the grayscale variation value with a predetermined grayscale variation threshold. Specifically, when the grayscale variation value obtained by the comparing circuit is greater than the predetermined grayscale variation threshold, a PWM generating circuit of the master control circuit generates a PWM signal and outputs the PWM signal to a backlight driving circuit; when the grayscale variation value obtained by the comparing circuit is less than or equals to the predetermined grayscale variation threshold, a PFM generating circuit 104 of the master control circuit generates a PFM signal and outputs the PFM signal to the backlight driving circuit;

the backlight driving circuit dims the through the inputted PWM signal or the inputted PFM signal. Further, specifically, the backlight driving circuit changes a current of the backlight source for dimming, so as to achieve the grayscale value of the target frame.

Further, the grayscale variation threshold may be about 10% of the range of grayscale value, and the grayscale value of the image is between 0 and 255. That is, the grayscale variation threshold may be set as 26.

Specifically, in the backlight adjusting process, when the PFM generating circuit generates the PFM signal, it may it may further adjust a time interval of the PFM signal in real time until a backlight current currently outputted to the backlight source by the backlight driving circuit achieves a target value of the backlight current according to the backlight current currently outputted to the backlight source by the backlight driving circuit. In other words, the PFM generating circuit may adjust the time interval of the PFM signal in real time until the grayscale value of the current frame equals to the grayscale value of the target frame.

Specifically, in the backlight adjusting process, when the PWM generating circuit generates the PWM signal, it may further adjust a duty cycle of the PWM signal in real time until a backlight current currently outputted to the backlight source by the backlight driving circuit achieves a target value of the backlight current according to the backlight current currently outputted to the backlight source by the backlight driving circuit. In other words, the PWM generating circuit may adjust the duty cycle of the PWM signal in real time until the grayscale value of the current frame equals to the grayscale value of the target frame.

The above embodiments do not constitute a limitation of protection scope of the technical solution. Any modifications equivalent replacement and improvement made within the spirit and principle of the above embodiments should be included within the protection scope of the technical solution.

What is claimed is:

1. A backlight driving circuit, comprising a backlight source, an image collecting circuit, a comparing circuit, a pulse width modulation (PWM) generating circuit, a pulse frequency modulation (PFM) generating circuit, a driving circuit and a backlight driving circuit, wherein the image collecting circuit is used to output a grayscale value of a current frame to the driving circuit;

wherein the driving circuit is used to calculate a grayscale variation value of a grayscale value of a target frame and the grayscale value of the current frame, and transmit the grayscale variation value to the comparing circuit;

wherein the comparing circuit is used to compare the grayscale variation value calculated by the driving circuit with a predetermined grayscale variation threshold, and generate a control signal for the PWM generating circuit or a control signal for the PFM generating circuit;

wherein the PWM generating circuit is used to generate a PWM signal in response to the control signal for the PWM generating circuit and output the PWM signal to the backlight driving circuit;

wherein the PFM generating circuit is used to generate a PFM signal in response to the control signal for the PFM generating circuit and output the PFM signal to the backlight driving circuit;

wherein the backlight driving circuit is used to change a current of the backlight source for dimming in response to the PWM signal or the PFM signal; and wherein the predetermined grayscale variation threshold of the comparing circuit is 26.

2. The backlight driving circuit according to claim 1, wherein the PFM generating circuit for generating the PFM signal comprises adjusting a time interval of the PFM signal in real time until a backlight current currently outputted to the backlight source by the backlight driving circuit achieves a target value of the backlight current according to the backlight current currently outputted to the backlight source by the backlight driving circuit.

3. The backlight driving circuit according to claim 1, wherein the PWM generating circuit for generating the PWM signal comprises adjusting a duty cycle of the PWM signal in real time until a backlight current currently outputted to the backlight source by the backlight driving circuit achieves a target value of the backlight current according to the backlight current currently outputted to the backlight source by the backlight driving circuit.

4. The backlight driving circuit according to claim 1, wherein the PWM generating circuit and the PFM generating circuit are respectively implemented by a square wave generator.

5. A liquid crystal display, comprising a backlight driving circuit, the backlight driving circuit comprises a backlight source, an image collecting circuit, a comparing circuit, a pulse width modulation (PWM) generating circuit, a pulse frequency modulation (PFM) generating circuit, a driving circuit and a backlight driving circuit, wherein the image collecting circuit is used to output a grayscale value of a current frame to the driving circuit;

wherein the driving circuit is used to calculate a grayscale variation value of a grayscale value of a target frame and the grayscale value of the current frame, and transmit the grayscale variation value to the comparing circuit;

wherein the comparing circuit is used to compare the grayscale variation value calculated by the driving circuit with a predetermined grayscale variation threshold, and generate a control signal for the PWM generating circuit or a control signal for the PFM generating circuit;

wherein the PWM generating circuit is used to generate a PWM signal in response to the control signal for the PWM generating circuit and output the PWM signal to the backlight driving circuit;

wherein the PFM generating circuit is used to generate a PFM signal in response to the control signal for the PFM generating circuit and output the PFM signal to the backlight driving circuit;

wherein the backlight driving circuit is used to change a current of the backlight source for dimming in response to the PWM signal or the PFM signal; and wherein the predetermined grayscale variation threshold of the comparing circuit is 26.

6. The liquid crystal display according to claim 5, wherein the PFM generating circuit for generating the PFM signal comprises adjusting a time interval of the PFM signal in real time until a backlight current currently outputted to the backlight source by the backlight driving circuit achieves a target value of the backlight current according to the backlight current currently outputted to the backlight source by the backlight driving circuit.

7. The liquid crystal display according to claim 5, wherein the PWM generating circuit for generating the PWM signal comprises adjusting a duty cycle of the PWM signal in real time until a backlight current currently outputted to the backlight source by the backlight driving circuit achieves a target value of the backlight current according to the backlight current currently outputted to the backlight source by the backlight driving circuit.

8. The liquid crystal display according to claim 5, wherein the PWM generating circuit and the PFM generating circuit are respectively implemented by a square wave generator.

9. A backlight adjusting method, comprising:

transmitting a grayscale value of a current frame to a driving circuit by a image collecting circuit;

calculating a grayscale variation value of a grayscale value of a target frame and the grayscale value of the current frame, and transmitting the grayscale variation value to a comparing circuit by the driving circuit;

comparing the grayscale variation value with a predetermined grayscale variation threshold by the comparing circuit; when the grayscale variation value obtained by the comparing circuit is greater than the predetermined grayscale variation threshold, a pulse width modulation (PWM) generating circuit generates a PWM signal and outputs the PWM signal to a backlight driving circuit; when the grayscale variation value obtained by the comparing circuit is less than or equals to the predetermined grayscale variation threshold, a PFM generating circuit generates a PFM signal and outputs the PFM signal to the backlight driving circuit;

dimming by the backlight driving circuit through the inputted PWM signal or the inputted PFM signal; and wherein the predetermined grayscale variation threshold of the comparing circuit is 26.

10. The backlight adjusting method according to claim 9, wherein the PFM generating circuit for generating the PFM signal comprises adjusting a time interval of the PFM signal in real time until a backlight current currently outputted to the backlight source by the backlight driving circuit achieves a target value of the backlight current according to the backlight current currently outputted to the backlight source by the backlight driving circuit.

11. The backlight adjusting method according to claim 9, wherein the PWM generating circuit for generating the PWM signal comprises adjusting a duty cycle of the PWM signal in real time until a backlight current currently outputted to the backlight source by the backlight driving circuit achieves a target value of the backlight current according to the backlight current currently outputted to the backlight source by the backlight driving circuit.

* * * * *